US009257023B2

(12) United States Patent
Lee et al.

(10) Patent No.: US 9,257,023 B2
(45) Date of Patent: Feb. 9, 2016

(54) MEDIA DEVICE AND CONTROL METHOD THEREOF

(71) Applicant: LG ELECTRONICS INC., Seoul (KR)

(72) Inventors: Hakjoo Lee, Seoul (KR); Yeosun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 222 days.

(21) Appl. No.: 14/095,536

(22) Filed: Dec. 3, 2013

(65) Prior Publication Data

US 2014/0159910 A1 Jun. 12, 2014

(30) Foreign Application Priority Data

Dec. 12, 2012 (KR) ..... 10-2012-0144624

(51) Int. Cl.
*G08B 27/00* (2006.01)
*G08B 7/06* (2006.01)

(52) U.S. Cl.
CPC ..... *G08B 7/066* (2013.01); *G08B 27/008* (2013.01)

(58) Field of Classification Search
CPC ..... G08B 27/008; G08B 7/066
USPC ..... 340/691.6
See application file for complete search history.

(56) References Cited

U.S. PATENT DOCUMENTS 7,579,945 B1 * 8/2009 Richter ..... G08B 7/066 340/286.14
2004/0236547 A1 * 11/2004 Rappaport ..... G06F 17/509 703/2
2008/0314681 A1 * 12/2008 Patel ..... A62B 3/00 182/18

* cited by examiner

*Primary Examiner* — Omer S Khan
(74) *Attorney, Agent, or Firm* — Birch, Stewart, Kolasch & Birch, LLP

(57) ABSTRACT

A media device connected to an external device and a control method thereof are provided. The media device includes a display unit configured to output a plan view denoting a structure of a building, a signal input/output unit configured to, when emergency occurs, receive information regarding a location in which emergency has occurred from a management center, and a controller configured to classify a plurality of emergency exits disposed in the building into available emergency exits and unavailable emergency exits by using the location information, map a fire escape route leading to an emergency exit closest to the location in which the media device is installed, among the available emergency exits.

6 Claims, 7 Drawing Sheets

MEDIA DEVICE AND CONTROL METHOD THEREOF

CROSS-REFERENCE TO RELATED APPLICATION

Pursuant to 35 U.S.C. §119(a), this application claims the benefit of earlier filing date and right of priority to Korean Application No. 10-2012-0144624, filed on Dec. 12, 2012, the contents of which is incorporated by reference herein in its entirety.

BACKGROUND OF THE INVENTION

1. Field of the Invention

The present disclosure relates to a media device, and particularly, to a media device connected to an external device and a control method thereof.

2. Background of the Invention

A media device includes both a device for recording and reproducing a video and a device for recording and reproducing audio. A device for recording and reproducing a video includes a TV, a computer monitor, a projector, and the like, as image display devices.

As image display devices have been diversified in functions, they have been implemented as multimedia players having complicated functions such as capturing images or video, playing games, receiving broadcast signals, and the like, as well as functions of reproducing music or video files. In addition, in order to support and increase functions of media devices, improvement of structural parts and software parts may be considered.

A media device may receive a data stream including a broadcast signal, extract video and audio data streams corresponding to a channel desired by a user by using service information included in the received data streams, and output the extracted video and audio data streams to a display device.

Recently, a data broadcast allowing for adding additional data to a digital broadcast, or the like, and sending the same, thus providing various types of information to users, have been provided. For example, information regarding programs of broadcast channels, subtitle information, weather information, news information, shopping information, and the like, may be provided to users.

A head end may be placed in a limited area such as a hotel and broadcast signals may be received from the outside and retransmitted to a plurality of media devices, e.g., TVs disposed in hotel rooms, or content stored in the head end or a database connected thereto may be retransmitted to a plurality of media devices.

Propelled by such improvements, a plurality of media devices may be installed in buildings such as hotels, nursing homes, and the like, and a management center connected to the installed media devices may perform controlling in relation to the media devices. Accordingly, the media devices may display additional information received from the management center. In this case, however, output information may need to vary according to locations in which media devices are installed.

SUMMARY OF THE INVENTION

Therefore, an aspect of the detailed description is to provide a media device capable of displaying different information according to locations in which media devices are installed, and a control method thereof.

To achieve these and other advantages and in accordance with the purpose of this specification, as embodied and broadly described herein, a media device is provided. The media device may include: a display unit configured to output a plan view denoting a structure of a building; a signal input/output unit configured to, when emergency occurs, receive information regarding a location in which emergency has occurred from a management center; and a controller configured to classify a plurality of emergency exits disposed in the building into available emergency exits and unavailable emergency exits by using the location information, map a fire escape route leading to an emergency exit closest to the location in which the media device is installed, among the available emergency exits, and output the same.

In an exemplary embodiment related to the present disclosure, the location information may include a wake-up signal for waking up a power-off state, and the controller may supply power to the display unit to output at least one of the plan view and the fire escape route in response to the wake-up signal.

In another exemplary embodiment related to the present disclosure, when there is no available emergency exit among the plurality of emergency exits, the controller may transmit a rescue request signal to the management center by using the signal input/output unit. In this case, the controller may output information regarding how to cope with the emergency, instead of the plan view.

In another exemplary embodiment related to the present disclosure, in outputting the plan view, the controller may output the available emergency exits and the unavailable emergency exits discriminately.

In another exemplary embodiment related to the present disclosure, the controller may capture an image of the plan view to which the fire escape route is mapped, and transmit the captured image data to an external terminal.

To achieve these and other advantages and in accordance with the purpose of this specification, as embodied and broadly described herein, a method of controlling a media device is provided. The method of controlling a media device may include: when emergency occurs in a building, receiving information regarding a location in which the emergency has occurred from a management center; classifying a plurality of emergency exits disposed in the building into available emergency exits and unavailable emergency exits by using the received location information; calculating a fire escape route leading to an emergency exit closest to the location in which a media device is installed among the available emergency exits; and outputting a plan view denoting a structure of the building to a display unit, and mapping the calculated fire escape route to the plan view and outputting the same.

In an exemplary embodiment related to the present disclosure, the location information may include a wake-up signal for waking up a power-off state, and the method may further include: supplying power to the display unit to output at least one of the plan view and the fire escape route in response to the wake-up signal.

In another exemplary embodiment related to the present disclosure, the method may further include: when there is no available emergency exit among the plurality of emergency exits, transmitting a rescue request signal to the management center.

In another exemplary embodiment related to the present disclosure, the method may further include: capturing an image of the plan view to which the fire escape route is mapped, and transmitting the captured image data to an external terminal.

Further scope of applicability of the present application will become more apparent from the detailed description given hereinafter. However, it should be understood that the detailed description and specific examples, while indicating preferred exemplary embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
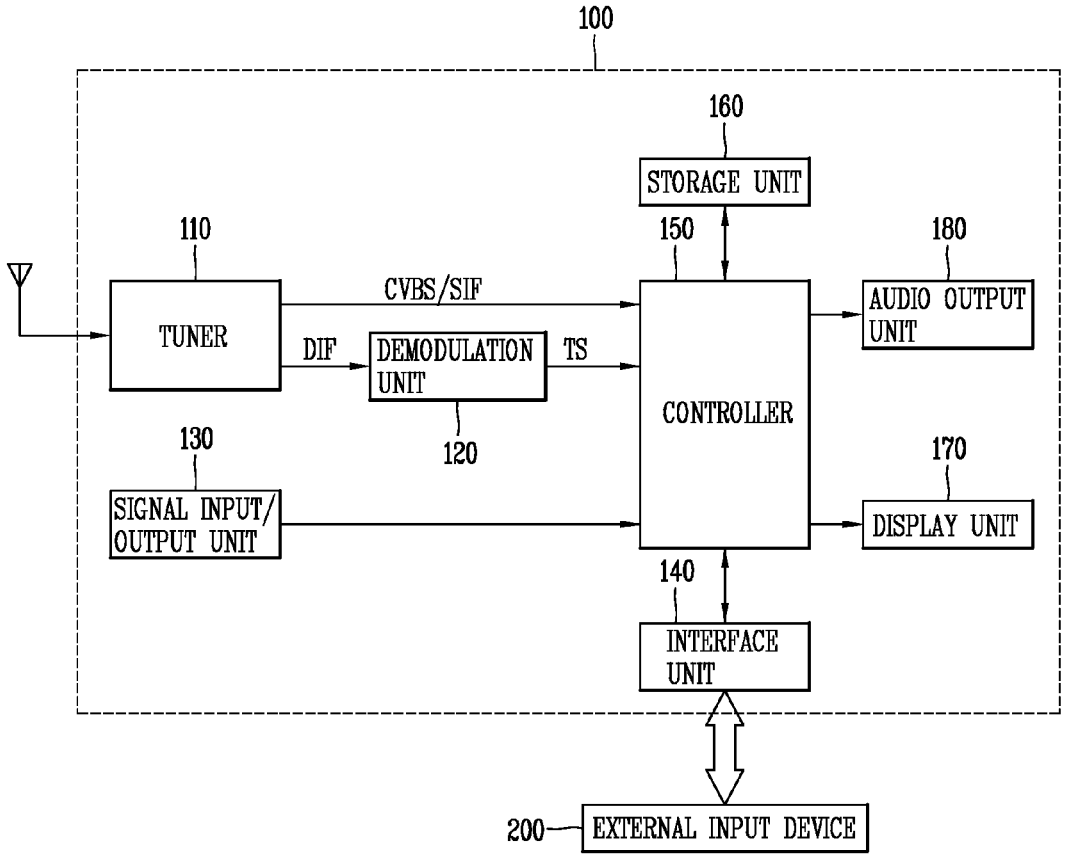
FIG. 1 is a block diagram illustrating a media device in relation to the present disclosure and an external input device.

Hereinafter, exemplary embodiments will be described in detail with reference to the accompanying drawings such that they can be easily practiced by those skilled in the art to which the present disclosure pertains. In describing the present disclosure, if a detailed explanation for a related known function or construction is considered to unnecessarily divert the gist of the present disclosure, such explanation will be omitted but would be understood by those skilled in the art. Also, similar reference numerals are used for the similar parts throughout the specification.

A media device according to the present exemplary embodiment includes both a device for recording and reproducing a video and a device for recording and reproducing audio. The device for recording and reproducing a video may be an image display device including a TV, a computer monitor, a projector, and the like.

FIG. 1 is a block diagram illustrating a media device 100 in relation to the present disclosure and an external input device 200. The media device 100 may include a tuner 110, a demodulating unit 120, a signal input/output unit 130, an interface unit 140, a controller 150, a storage unit 160, a display unit 170, and an audio output unit 180.

Referring to FIG. 1, the tuner 110 selects an radio frequency (RF) broadcast signal corresponding to a channel selected by a user among RF broadcast signals received through an antenna, and converts the selected RF broadcast signal into an intermediate frequency (IF) signal or a baseband video/audio signal. For example, when the RF broadcast signal is a digital broadcast signal, the tuner 110 converts the RF broadcast signal into a digital IF (DIF) signal. Meanwhile, when the RF broadcast signal is an analog broadcast signal, the tuner 110 converts the RF broadcast signal into an analog baseband video/audio signal (CVBS/SIF). In this manner, the tuner 110 may be a hybrid tuner capable of processing a digital broadcast signal and an analog broadcast signal.

The digital IF (DIF) signal output from the tuner 110 may be input to the demodulation unit 120, and the analog baseband video/audio signal 9CVBS/SIF) output from the tuner 110 may be input to the controller 160. The tuner 120 may receive an RF broadcast signal of a single carrier according to an advanced television systems committee (ATSC) scheme or RF broadcast signals of a plurality of carriers according to a digital video broadcasting scheme.

Although a single tuner 110 is illustrated but the present inventive concept is not limited thereto and the media device 100 may include a plurality of tuners, for example, first and second tuners. In this case, the first tuner may receive a first RF broadcast signal corresponding to a broadcast signal selected by a user and the second tuner may sequentially or periodically receive a second RF broadcast signal corresponding to a stored broadcast signal. The second tuner may convert the RF broadcast signal into a digital IF (DIF) signal or an analog baseband video/audio signal 9CVBS/SIF), like the first tuner.

The demodulation unit 120 may receive the converted digital IF (DIF) signal from the tuner 110 and perform a demodulation operation thereon. For example, when the digital IF signal (DIF) output from the tuner 110 is based on an ATSC scheme, the demodulation unit 120 may perform 8-vestigal side band (8-VSB) demodulation. Here, the demodulation unit 120 may perform channel decoding such as trellis decoding, deinterleaving, Reed-Solomon decoding, or the like. To this end, the demodulation unit 120 may include a trellis decoder, a deinterleaver, a Reed-Solomon decoder, and the like.

In another example, when the digital IF (DIF) signal output from the tuner 110 is based on a DVB scheme, the demodulation unit 120 performs coded orthogonal frequency division modulation (COFDMA) demodulation. Here, the demodulation unit 120 may perform channel decoding such as convolution decoding, deinterleaving, Reed-Solomon decoding, or the like. To this end, the demodulation unit 120 may include a convolution decoder, a deinterleaver, and a Reed-Solomon decoder, or the like.

The signal input/output unit 130 may be connected to an external device and perform a signal input and output operation. To this end, the signal input/output unit 130 may include an A/V input/output unit and a wireless communication unit.

The A/V input/output unit may include an Ethernet terminal, a universal serial bus (USB) terminal, a composite video banking sync (CVBS) terminal, a component terminal, an S-video terminal (analog), a digital visual (DV) interface terminal, a high definition multimedia interface (HDMI) terminal, a mobile high-definition link (MHL) terminal, an RGB terminal, a D-SUB terminal, an IEEE 1394 terminal, an SPDIF terminal, a liquid HD terminal, and the like. A digital signal input through these terminals may be delivered to the controller 150. Here, an analog signal input through the CVBS terminal and the S-video terminal may be converted into a digital signal through an analog-digital conversion unit (not shown) and delivered to the controller 150.

The wireless communication unit may perform a wireless Internet connection. For example, the wireless communication unit may perform a wireless Internet connection by using a wireless LAN (WLAN), Wi-Fi, wireless broadband (Wibro), world interoperability for microwave access (Wimax), high speed downlink packet access (HSDPA), and the like. Also, the wireless communication unit may perform short-range wireless communication with a different electronic device. For example, the wireless communication unit may perform short-range wireless communication by using Bluetooth, radio frequency identification (RFID), infrared data association (IrDA), ultra wideband (UWB), ZigBee, or the like.

The signal input/output unit 130 may deliver a video signal, an audio signal, and a data signal provided from an external device such as a digital versatile disk (DVD) player, a Blu-ray player, a game player, a camcorder, a computer (a notebook computer), a portable device, a smartphone, and the like, to the controller 150. Also, the signal input/output unit 130 may deliver a video signal, an audio signal, and a data signal of various media files stored in an external storage device such as a memory device, a hard disk, or the like, to the controller 150. Also, the signal input/output unit 130 may output a video signal, an audio signal, and a data signal processed by the controller 150 to a different external device.

The signal input/output unit 130 may be connected to a set-top box, for example, a set-top box for an Internet protocol (TV), through at least one of the various terminals as mentioned above to perform a signal input and output operation. For example, the signal input/output unit 130 may deliver a video signal, an audio signal, and a data signal processed by the set-top box for an IPTV such that bi-directional communication is available, to the controller 150, and may deliver the signals processed by the controller 150 to the set-top box for an IPTV. Here, the IPTV may include an ADSL-TV, a VDSL-TV, an FTTH-TV, and the like, differentiated according to a transmission network.

Digital signals output from the demodulation unit 120 and the signal output unit 130 may include a stream signal (TS). The stream Signal TS may be a signal obtained by multiplexing a video signal, an audio signal, and a data signal. For example, the stream signal TS may be an MPEG-2 transport stream (TS) in which a video signal of the MPEG-2 standard, an audio signal of the dolby AC-3 standard, and the like, are multiplexed. Here, the MPEG-2 TS may include a 4-byte header and 184-byte payload.

The interface unit 140 may receive an input signal for power control, channel selection, screen setting, and the like, from the external input device 200, or may transmit a signal processed by the controller 160 to the external input device 200. The interface unit 140 and the external input device 200 may be connected in a wired manner or wirelessly.

A network interface unit (not shown) provides an interface for connecting the media device 100 to a wired/wireless network including the Internet. The network interface unit (not shown) may include an Ethernet terminal, or the like, for a connection to a wired network, and the WLAN, Wi-Fi, Wibro, Wimax, HSDPA communication standard, and the like, may be used for a connection to a wireless network.

The network interface unit (not shown) may be connected to a predetermined Web page via a network. Namely, the network interface unit (not shown) may be connected to a predetermined Web page to transmit and receive data to and from a corresponding server. Besides, the network interface unit (not shown) may receive content or data provided by a content provider or a network operator. Namely, the network interface unit (not shown) may receive content such as movie, advertisement, game, VOD, broadcast signals, and the like, provided by a content provider or a network provider and information related thereto. Also, the network interface unit (not shown) may receive updated information or updated file of firmware provided by a network operator. Also, the network interface unit may transmit data to an Internet or content provider or a network operator.

Also, the network interface unit (not shown) may selectively receive a desired application among applications open to the public via a network.

The controller 150 may control a general operation of the media device 100. For example, the controller 150 may control the tuner 110 to tune an RF broadcast signal corresponding to a channel selected by a user or a stored channel. Although not shown, the controller 150 may include a demultiplexing unit, a video processing unit, an audio processing unit, a data processing unit, an on-screen display (OSD) generating unit, and the like.

The controller 150 may demultiplex a stream signal TS, e.g., an MPEG-2 TS to separate it into a video signal, an audio signal, and a data signal.

The controller 150 may process the demultiplexed video signal, e.g., perform decoding on the demultiplexed video signal. In detail, the controller 150 may decode a coded video signal of the MPEG-2 standard by using an MPEG-2 decoder, and decode a coded video signal of the H.264 standard according to a digital multimedia broadcasting scheme or a DVB-H by using an H.264 decoder. Also, the controller 150 may process the video signal to adjust brightness, tint, color, and the like, of an image. The video signal processed by the controller 150 may be delivered to the display unit 170 or may be delivered to an external output device (not shown) through an external output terminal.

The controller 150 may process the demultiplexed audio signal. For example, the controller 150 may perform decoding on the demultiplexed audio signal. In detail, the controller 150 may decode the coded audio signal of the MPEG-2 standard by using an MPEG 2 decoder, may decode the coded audio signal of an MPEG 4 bit sliced arithmetic coding (BSAC) according to a DMB scheme by using an MPEG 4 decoder, and may decode the coded audio signal of the advanced audio codec (AAC) standard of MPEG 2 according to a satellite DMB scheme or DVB-H. Also, the controller 150 may process base, treble, volume control, and the like. The audio signal processed by the controller 150 may be delivered to an audio output unit 180, for example, a speaker, or may be delivered to an external output device.

The controller 150 may process an analog baseband video/audio signal (CVBS/SIF). Here, the analog baseband video/audio signal (CVBS/SIF) input to the controller 150 may be an analog baseband video/audio signal output from the tuner 110 or the signal input/output unit 130. The processed video signal may be displayed through the display unit 170, and the processed audio signal may b output through the audio output unit 180.

The controller 150 may process the demultiplexed data signal. For example, the controller 150 may perform decoding on the demultiplexed data signal. Here, the data signal may include electronic program guide (EPG) information including a start time, a terminate time, or the like, of a broadcast program aired in each channel. In an ATSC scheme, the EPG information may include ATSC-program and system information protocol (ATSC-PSIP), and in a DVB scheme, the EPG information may include DVB-service information (SI). The ATSC-PSIP information or the DVB-SI information may be included in a header (4 byte) of an MPEG-2 TS.

The controller 150 may perform a control operation to process OSD. In detail, the controller 150 may generate an OSD signal for displaying various types of information in a graphic or text form on the basis of at least one of a video signal and a data signal or an input signal received from the external input device 200. The OSD signal may include various types of data such as a user interface screen, a menu screen, a widget, an icon, and the like.

The storage unit 160 may store a program for processing or controlling signals, or may store a processed video signal, audio signal, and data signal. The storage unit 160 may include at least one of a flash memory, a hard disk type memory, a multimedia card micro type memory, a card type memory (e.g., an SD or XD memory), a random access memory (RAM), a static RAM (SRAM), a read-only memory (ROM), an electrically erasable programmable ROM (EEPROM), a programmable ROM (PROM), a magnetic memory, a magnetic disk, and an optical disk.

The display unit 170 may convert the video signal, the data signal, the OSD signal, and the like, processed by the controller 150 into RGB signals to output an image. The display unit 170 may include at least one of a plasma display panel (PDP), a liquid crystal display (LCD), a thin film transistor-LCD (TFT-LCD), an organic light emitting diode (OLED) display, a flexible display, a three-dimensional (3D) display, an e-ink display, and the like. Also, the display unit 170 may be implemented as a touch screen to serve as an input device.

The audio output unit 180 may output an audio signal, for example, a stereo signal or a 5.1-channel signal, processed by the controller 150. The audio output unit 180 may be implemented as various types of speakers.

Meanwhile, an image capturing unit (not shown) for capturing an image of the user may be further provided. The image capturing unit (not shown) may be implemented as a single camera but the present inventive concept is not limited thereto and the image capturing unit may be implemented as a plurality of cameras. Image information captured by the image capturing unit (not shown) may be input to the controller 150.

Meanwhile, in order to sense a user gesture, as mentioned above, a sensing unit (not shown) including at least one of a touch sensor, a voice sensor, a position sensor, and an operating sensor may be further provided in the media device. A signal sensed by the sensing unit (not shown) may be delivered to the controller 150 through the interface unit 140.

The controller 150 may sense a user gesture according to the image captured by the image capturing unit (not shown) or the signal sensed by the sensing unit (not shown), separately, or by combining these signals.

A power supply unit (not shown) supplies power to the media device 100. In particular, the power supply unit (not shown) may supply power to the controller 150 that may be implemented in the form of a system on chip (SOC), the display unit 170 for displaying an image, and the audio output unit 180 for outputting audio.

To this end, the power supply unit (not shown) may include a converter (not shown) for converting alternating current (AC) power into direct current (DC) power. Meanwhile, for example, in a case in which the display unit 170 is implemented as a liquid crystal panel having a plurality of backlight lamps, the power supply unit (not shown) may further include an inverter (not shown) that may be able to perform a pulse width modulation (PWM) operation for the purpose of varying luminance or dimming driving.

The external input device 200 may be connected to the interface unit 140 in a wired manner or wirelessly, and may transmit an input signal generated according to a user input to the interface unit 140. The external input device 200 may include a remote control device, a mouse, a keyboard, and the like. The remote control device may transmit an input signal to the interface unit 140 through Bluetooth, RF communication, infrared communication, ultra-wideband (UWB), ZigBee, and the like. The remote control device may be implemented as a spatial remote control device. The spatial remote control device may generate an input signal by sensing an operation of a body in a space.

The media device 100 may be implemented as a fixed type digital broadcast receiver capable of receiving at least one of an ATSC-type (8-VSB-type) digital broadcast, a DVB-T type (COFDM-type) digital broadcast, an ISDB-T type (BST-OFDM-type) digital broadcast, and the like. Also, the media device 100 may be implemented as a mobile digital broadcast receiver capable of receiving at least one of a terrestrial digital multimedia broadcasting-type digital broadcast, a satellite DMB-type digital broadcast, an ATSC-M/H type digital broadcast, a DVB-H type (COFDM type) digital broadcast, a media forward link only type digital broadcast, and the like. Also, the media device 100 may be implemented as a digital broadcast receiver for a cable, satellite communication, and an IPTV.

Figure 2:
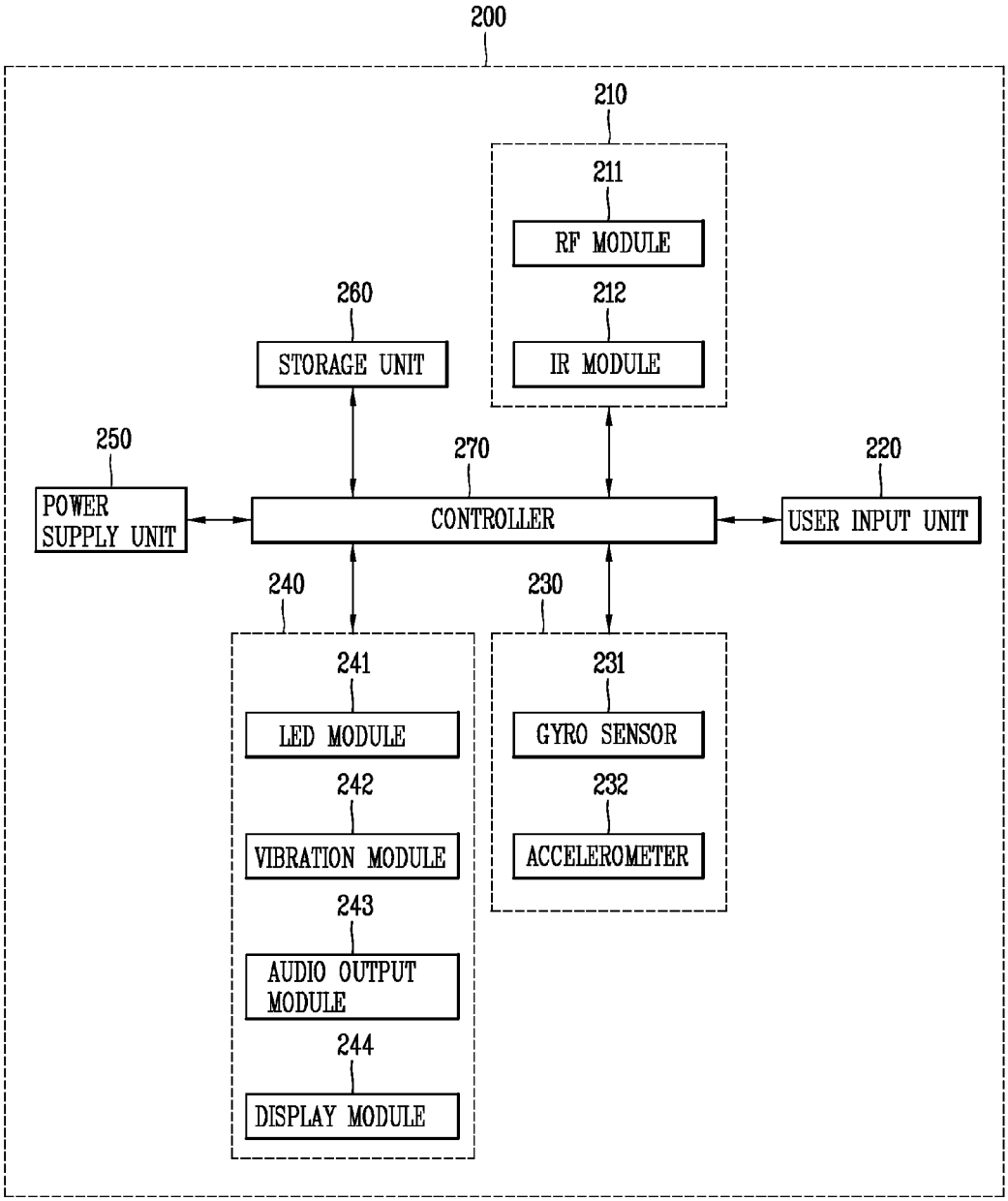
FIG. 2 is a block diagram specifically illustrating the external input device of FIG. 1.

FIG. 2 is a block diagram specifically illustrating the external input device 200 of FIG. 1. The external input device 200 may include a wireless communication unit 210, a user input unit 220, a sensing unit 230, an output unit 240, a power supply unit 250, a storage unit 260, and a controller 270.

Referring to FIG. 2, the wireless communication unit 210 may transmit a signal to the media device 100 or may receive a signal from the media device 100. To this end, the wireless communication unit 210 may include an RF module 211 and an IR module 212. The RF module 211 is connected to the interface unit 140 of the media device 100 according to an RF communication standard to transmit and receive a signal, and the IR module 212 is connected to the interface unit 140 of the media device 100 according to an IR communication standard to transmit and receive a signal.

The user input unit 220 may include a keypad, a key button, a scroll key, a jog key, and the like, as an input means. The user may input a command in relation to the media device 100 by manipulating the user input unit 220. Such a command may be input by the user through a push operation of a hard key button of the user input unit 200.

The sensing unit 230 may include a gyro sensor 231 and an accelerometer 232. The gyro sensor 231 may sense a spatial movement of the external input device 200 on the basis of an x axis, a y axis, and a z axis. The accelerometer 232 may sense a movement speed, or the like, of the external input device 200.

The output unit 240 may output information corresponding to manipulation of the user input unit 230 and information corresponding to a transmission signal of the media device 100. Thus, the user may recognize a manipulation state of the user input unit 230 or a control state of the media device 100 through the output unit 230. For example, the output unit 240 may include an LED module 241, a vibration module 242, an audio output module 243, and a display module 244. In response to a manipulation of the user input unit 230 or a signal transmission and reception through the wireless communication unit 210, the LED module 241 may be turned on, the vibration module 242 may generate vibrations, and the display module 244 may output an image.

The power supply unit 250 may supply power to various electronic elements of the external input device 200. When the external input device 200 does not move for a predetermined period of time, the power supply unit 250 may stop power supply to reduce power consumption. When a predetermined key of the external input device 200 is manipulated, the power supply unit 250 may resume power supply.

The storage unit 260 may store various programs, applications, frequency band information, and the like, in relation to controlling or operation of the external input device 200. The controller 270 may perform a general controlling operation of the external input device 200.

Figure 3:
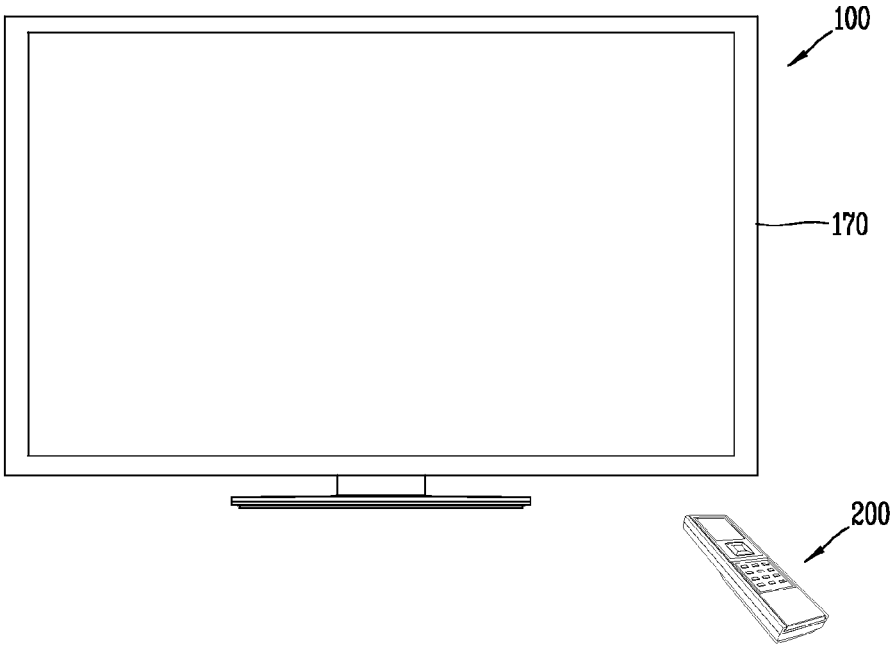
FIG. 3 is a conceptual view illustrating an interaction between the media device in relation to the present disclosure and the external device.

FIG. 3 is a conceptual view illustrating an interaction between the media device 100 in relation to the present disclosure and the external input device 200. Here, a TV receiver is illustrated as the media device 100 and a remote controller is illustrated as the external input device 200, for example.

Referring to FIG. 3, the external input device 200 may transmit or receive a signal to and from the media device 100 according to an RF communication standard. A control menu may be displayed on a screen of the media device 100 according to a control signal from the external input device 200. The external input device 200 may include a plurality of buttons, and may generate an external input signal according to a user's button manipulation.

Figure 4:
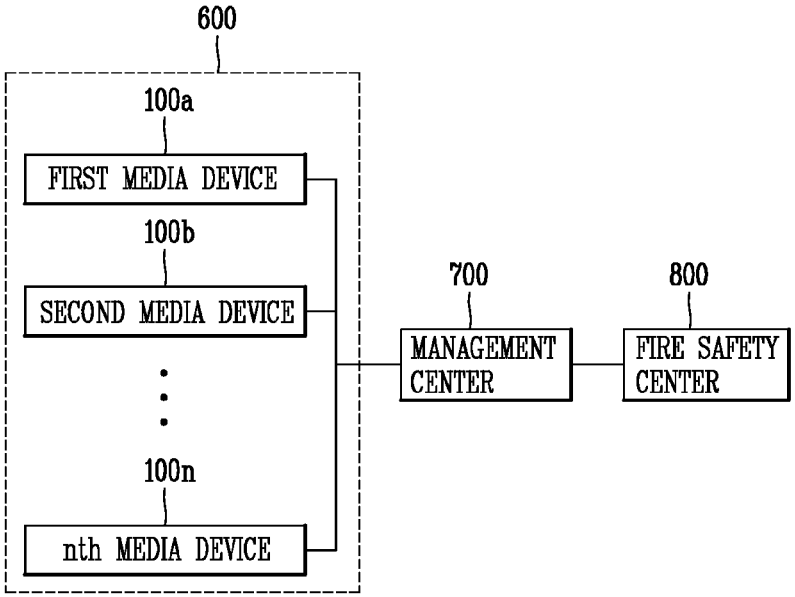
FIG. 4 is a view illustrating a system including the media device according to an exemplary embodiment of the present disclosure.

FIG. 4 is a view illustrating a system including the media device according to an exemplary embodiment of the present disclosure.

Referring to FIG. 4, a system according to an exemplary embodiment of the present disclosure may include a predetermined region 600, at least one media device 100 installed in the predetermined region 600, a management center 700, and a fire safety center 800.

The predetermined region 600 may be a region such as common facilities such as a hotel, a hospital, or the like. The common facilities may refer to public facilities directly or indirectly used by people. Thus, subway stations, underground shopping district, and the like, may be set as the predetermined region 600. Such a predetermined region 600 may be referred to as a 'building' in which people may live or things are kept.

At least one media device 100 may be installed in the predetermined region 600. For example, if the building is a hotel, the media device 100 may be installed in each room. The media device 100 may receive information from the management center 700 and reproduce (or play) relevant content by using the received information. Content may be referred to as digital content or multimedia content, and may be information such as text, an image, a video, audio, and the like, which is produced, processed, and distributed in a digital manner.

The management center 700 may refer to an external device that manages at least one media device 100 installed in the predetermined region 600. The management center 700 may receive a broadcast signal from the outside and transmit the same to the media device 100. The media device 100 may extract a video signal (which includes an audio signal, in general) corresponding to a channel selected by the user from received broadcast signals, process the extracted video signal, and output the processed signal to the display unit 170.

In more detail, the management center 700 may include a broadcast transmission device, a data server, and a charging server. The broadcast transmission device may provide a broadcast signal received from the outside through a satellite, a cable, or the like, to the media device 100. The data server may provide application data for a data broadcast service to the media device 100. The charging server may collect broadcast reception history of the media device 100 and other data, and charges for broadcast reception and any other services.

For example, the management center 700 may be installed in a hotel, and the media device 100 may be disposed in each room of the hotel. The management center 700 may transmit paid content according to a request from the media device 100. The charging server may generate billing data with respect to a client of each room by collecting fees on the basis of viewing history data regarding viewing of paid content and other fee data such as a room rate, and the like. The viewing history data may include an identification code of paid content viewed by the user, information regarding a channel of the content, a viewing time, a viewing date, and the like.

The broadcast transmission device (not shown) may include a plurality of broadcast signal receivers to receive various content from a plurality of broadcast providers by using a wired/wireless communication network through a terrestrial or satellite antenna, cable, or the like, and allocate the received content to a plurality of broadcast channels and re-transmit the same to the media device 100.

Meanwhile, the media device 100 may receive a video signal of a broadcast channel selected by the user from among broadcast signals transmitted from the broadcast transmission device, and receive application data for a data broadcast transmitted from a data server.

Also, the media device 100 may output the video signal of the received broadcast channel and application data for a data broadcast to the display unit 170. Also, the media device 100 may receive paid content from the broadcast transmission device or may store paid content therein. Also, the media device 100 may provide the paid content according to a user request.

In order to provide paid content, the media device 100 may generate a unique pin code in relation to a particular channel and the media device 100 itself. The media device 100 may receive a pin code from the user, and perform authentication by comparing the received pin code with the generated pin code. Only when the authentication is successfully performed, the media device 100 may request paid content from the broadcast transmission device or the data server. The received paid content may be output to the display unit 170. Here, the charging server of the management center 200 may detect the paid content request from the media device 100 and generate corresponding viewing history data.

The generated viewing history data may be changed into an amount and added to a different fee, e.g., a fee for a room, and the like.

The display unit 170 may display an image of the broadcast channel by using the video signal input to the media device 100, and may provide a data broadcast service according to a user request.

Referring to FIGS. 1 through 3, it is illustrated that the display unit 170 is integrated with the media device 100, like a TV, but the media device 100 and the display unit 170 may be configured as separate devices. For example, the media device 100 may be a set-top box that receives a broadcast signal by using a wired or wireless network, converts the received broadcast signal into a form that may be output by a display device, and outputs the same to the display unit 170.

However, the media device 100 according to an exemplary embodiment of the present disclosure is not limited to a TV or a set-top box and may include any type of devices that may be able to receive a broadcast signal transmitted from the outside and output the received broadcast signal to the display unit 170 connected in a wired manner or wirelessly.

The display unit 170 may display an image by using a signal input from the media device 100, and in this case, for example, the display unit 170 may display an image by using various display schemes such as a liquid crystal display (LCD), a plasma display panel (PDP), an electroluminescent display (ELDS), a vacuum fluorescent display (VFD), and the like.

Meanwhile, the media device 100 may be connected to the display unit 170 through a high definition multimedia interface (HDMI), a digital visual interface (DVI), a D-Sub cable, or the like. However, the connection between the media device 100 and the display unit 170 is not limited thereto and the media device 100 and the display unit 170 may be connected by using cables of various communication schemes. Also, the media device 100 and the display unit 170 is not limited to a connection in a wired manner and may be connected through a wireless network using short-range wireless communication such as ZigBee, Bluetooth, Wi-Fi, or the like.

According to the present disclosure, it is desirous that an image of a broadcast channel selected by the user and an image of a data broadcast service are simultaneously displayed on a single screen, and to this end, the media device 100 may synthesize or combine the image signal of the broadcast channel received from the broadcast transmission device and the application data received from the data server to process them so as to be displayed in a single screen, and subsequently output the same to the display unit 170.

Meanwhile, in order for the media device 100 to receive the application data for the data broadcast service from the data server without changing a currently viewed broadcast channel, the application data may be transmitted to the media device 100 through a data dedicated channel independent from the broadcast channel.

Namely, the broadcast transmission device may allocate broadcast signals received from the outside to a plurality of pre-set broadcast channels and transmit the same to the media device 100, and the data server may transmit the application data to the media device 100 through a data dedicated channel configured as an independent channel separate from the broadcast channels, whereby the media device 100 may simultaneously receive the video signal of the broadcast channel that the user is currently viewing and the application data for the data broadcast.

Accordingly, the user may request the data broadcast service while viewing the selected broadcast channel, and may use the data broadcast service provided from the data server of the management center 700, while continuously viewing the broadcast channel, without changing the broadcast channel.

According to an exemplary embodiment of the present disclosure, a broadcast system may be used to provide a data broadcast service in a limited space, for example, a particular building such as a hotel, a hospital, or the like.

Hereinafter, an exemplary embodiment of the present disclosure will be described by using a hotel broadcast system providing a data broadcast service together with a general broadcast service using a broadcast signal provided from the outside within a hotel, as an example.

The media device 100 and the display unit 170 are disposed within a room of a hotel, and the management center 700 may receive a broadcast signal from the outside by using a satellite, a cable, or the like, and transmit the received broadcast signal to a plurality of media devices 100 disposed in rooms together with application data for data broadcasting in the hotel.

For example, a data broadcast service in a hotel may be a room interactive service including various services that may be provided in a hotel, such as a pay per view (PPV), a room service, a hotel related information service, a reservation service, a checkout information service, an entertainment information service, a game service, and the like.

In particular, the management center 700 may collect information by using a sensor installed in a building, or the like, and detect whether emergency has occurred. For example, when emergency, such as a fire, or the like, occurs in a building, the management center 700 may provide information regarding the emergency. In this case, the management center 700 may output an alarm sound such as sirens or broadcast regarding the emergency to induce staff and guests to escape.

Here, the management center 700 may provide information regarding the emergency to the at least one media device 100 installed in the hotel such as room, or the like, and output an image for inducing escape.

For example, when emergency occurs in a building, the management center 700 may transmit information regarding a location in which emergency has occurred to the media devices 100*a* to 100*n*. Each of the media devices 100 may classify a plurality of emergency exits disposed in the building into available emergency exits and unavailable emergency exits by using the received location information. Also, each of the media devices 100 may calculate a fire escape route (or a rescue route) leading to an emergency exit closest to the location in which each media device 100 is installed, among the available emergency exits. Each of the media devices 100 may map the calculated fire/escape route to a plan view (or a floor plan) denoting a structure of the building and output the same to the display unit 170.

When emergency occurs in a building, the management center 700 may transmit information regarding a location in which the emergency has occurred to the fire safety center 800. For example, the fire safety center 800 may be a fire station adjacent to the building in which emergency has occurred.

According to the present disclosure, in the case in which emergency occurs, the media device 100 installed in the building may display a fire escape route leading to an emergency exit closest to the location in which the media device is installed, among the available emergency exits within the building. Since all of the media devices installed in the building display emergency exit information simultaneously when emergency occurs, people may be quickly and efficiently induced to escape.

Figure 5:
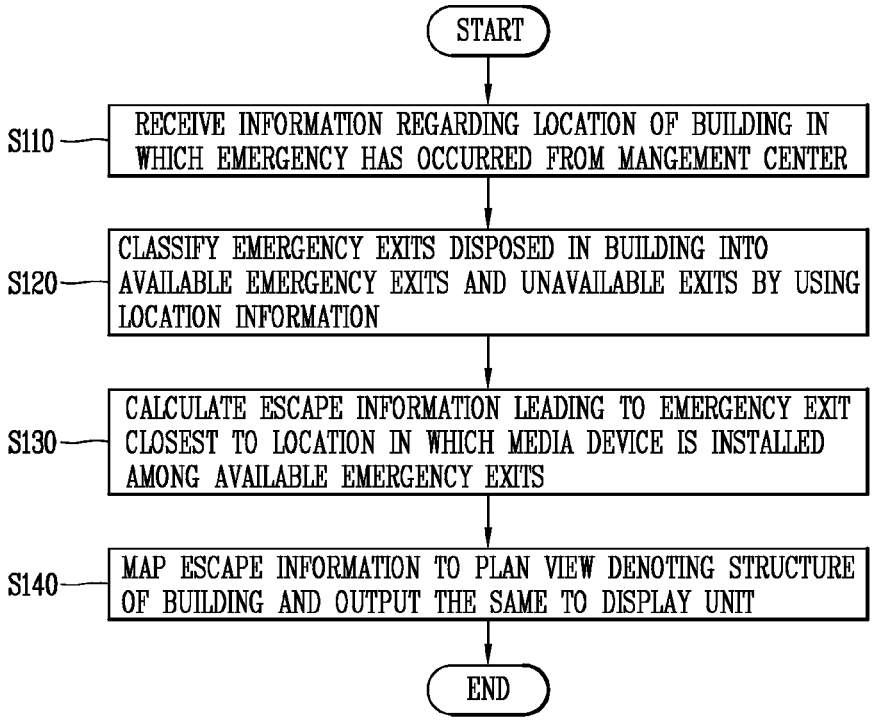
FIG. 5 is a flow chart illustrating a method of controlling a media device according to an exemplary embodiment of the present disclosure.

FIG. 5 is a flow chart illustrating a method of controlling a media device according to an exemplary embodiment of the present disclosure.

Referring to FIG. 5, the method for controlling a media device according to an exemplary embodiment of the present disclosure includes a step (S110) of receiving information regarding a location of a building in which emergency has occurred from the management center. The media device 100 may receive the location information from the management center 700 in a wired manner or wirelessly.

Next, a step (S120) of classifying emergency exits disposed in the building into available emergency exits and unavailable emergency exits by using the location information may be performed. According to Fire Services Act, a plurality of emergency exists may be disposed in the building. In general, the closest emergency exit needs to be guided or provided, but available emergency exits and unavailable emergency exits may be classified according to where a fire has broken out.

Thereafter, a step (S130) of calculating information regarding escape information (a fire escape route) leading to an emergency exit closest to the place in which the media device is installed among the available emergency exits may be performed. At least one emergency exit may be present in the building. Here, the controller 150 may calculate escape information leading to an emergency exit closest to the location in which the media device 100 is installed, among the available emergency exits. For example, the escape information may be a fire escape route leading to an emergency exit closest to the place in which the media device is installed. The fire escape route may refer to a line flow (or a circulation)

indicating a direction in which people should move to escape from the emergency to the outside of the building.

Thereafter, a step (S140) of mapping the escape information to a plan view denoting a structure of the building and outputting the same to the display unit may be performed. The controller 150 may output the plan view denoting the structure of the building to the display unit 170 in response to the location information received from the management center 700. Also, the controller 150 may map the fire escape route calculated by using the location information to the plan view and output the same.

Here, in displaying the plan view denoting the structure of the building, the controller 150 may discriminate between an available emergency exit and an unavailable emergency exit and output the same. For example, the controller 150 may output a graphic object indicating unavailability to the unavailable emergency exit. In another example, the controller 150 may flicker the available emergency exit or may output only the available emergency exit to the plan view.

Although not shown, the location information received from the management center 700 may include a wake-up signal for waking up a power-off state. Here, a step of supplying power to the display unit to output at least one of the plan view and the fire escape route in response to the wake-up signal may be performed.

In general, power of the media device 100 may be turned on or off according to a user input. However, when emergency occurs, power may be turned on by a wake-up signal. Namely, when a wake-up signal is received in a state in which power is tuned off, the controller 150 may supply power to the display unit 170 and output at least one of the plan view and the fire escape route mapped to the plan view.

Figure 6:
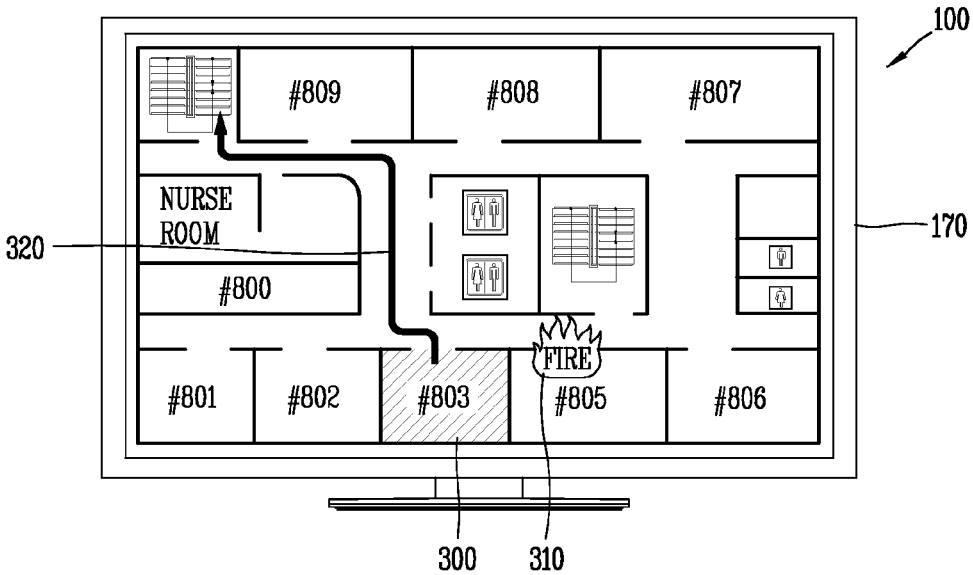
FIG. 6 is a view illustrating a media device according to an exemplary embodiment of the present disclosure.

FIG. 6 is a view illustrating a media device according to an exemplary embodiment of the present disclosure.

Referring to FIG. 6, the media device 100 according to an exemplary embodiment of the present disclosure may include the display unit 170 outputting a plan view denoting a structure of a building.

When emergency occurs, the media device 100 may receive information regarding a location of a building in which the emergency has occurred from the management center 700. For example, the location information may include a location at which a fire was broken out, an area in which an access is impossible because of a fire, and the like. Here, information regarding the plan view denoting the structure of the building and a location in which the media device 100 is installed, and the like, may have been stored in the storage unit 160. The controller 150 may calculate a fire escape route leading to an emergency exit closest to the place in which the media device 100 is installed by using the received location information and the information stored in the storage unit 160.

For example, referring to FIG. 6, the place in which the media device 100 is installed may be room #803 (300), and the media device 100 may receive location information 310 in which the emergency has occurred from the management center 700. Here, the media device 100 may map a fire escape route leading to the closest emergency exit through which people may escape a fire to the plan view denoting the structure of the building and display the same.

Figure 7A:
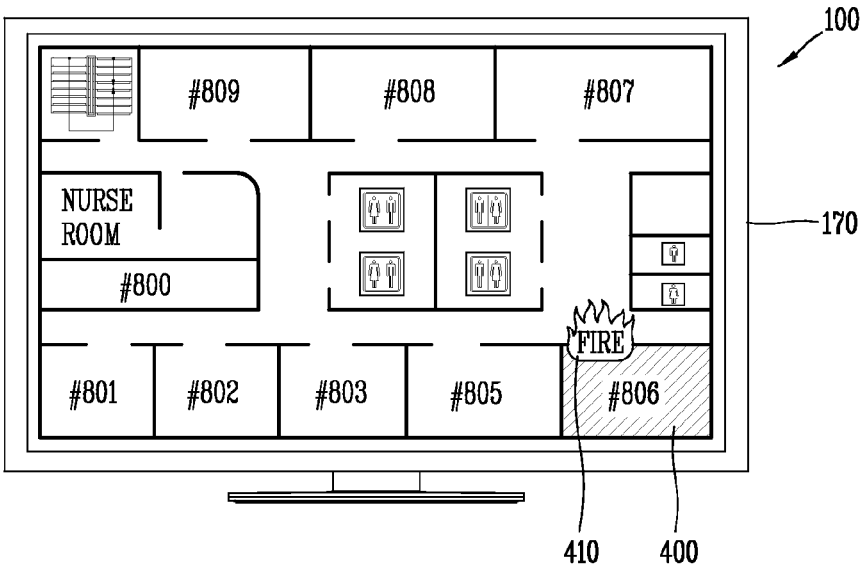
FIGS. 7A through 7C are views illustrating a media device according to an exemplary embodiment of the present disclosure.
Figure 7B:
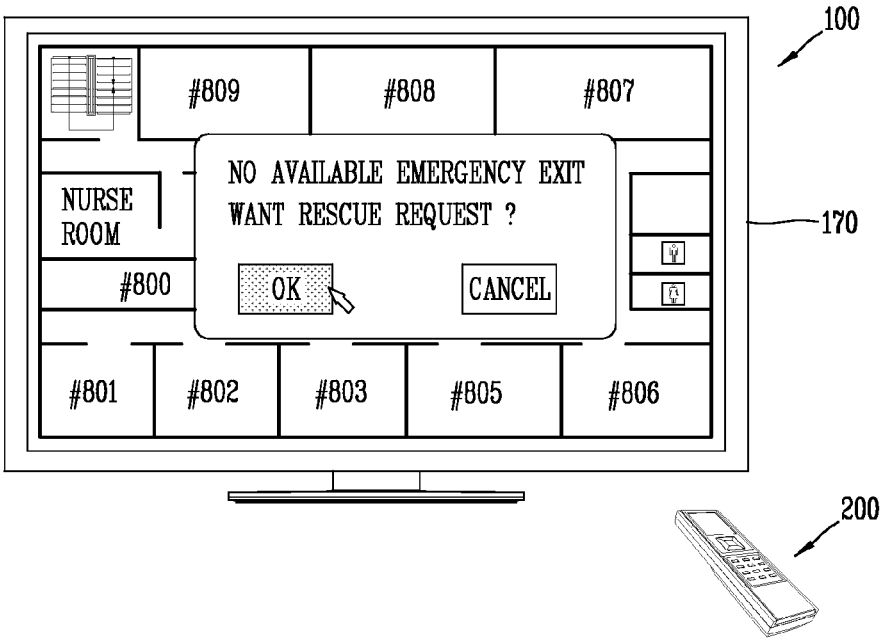
Figure 7C:
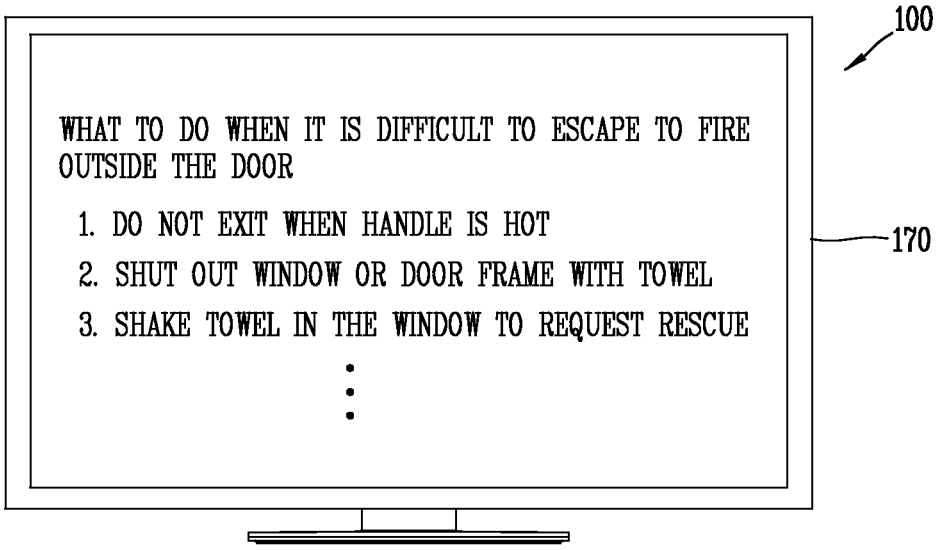

FIGS. 7A through 7C are views illustrating the media device according to an exemplary embodiment of the present disclosure.

Referring to FIG. 7A, the media device 100 according to an exemplary embodiment of the present disclosure, may classify a plurality of emergency exits disposed in the building into an available emergency exit and an unavailable emergency exit by using the location information.

Here, an available emergency exit may not be present in the location in which the media device 100 is installed. For example, in a case in which a fire 410 breaks out in front (410) of a particular room 400 (for example, room #806), people who use the particular room 400 may not use an emergency exit. In this case, the controller 150 may transmit a rescue request signal to the outside by using the signal input/output unit 130. For example, the controller 150 may transmit a rescue request signal to the management center 700. The rescue request signal may include room information, the number of users of the room, the names of the users of the room, a contact number, and the like.

Referring to FIG. 7B, in the case in which an available emergency exit does not exist, the controller 150 may output a message related to a rescue request as a pop-up window to the display unit 170. Here, the user may select whether to transmit the rescue request signal by using the external input device 200 as described above.

For example, when 'OK' is clicked, the controller 150 may transmit the rescue request signal to the management center 700. The management center 700 may transmit the rescue request signal to the fire safety center 800. Since the received rescue request signal indicates that there are people in need of rescue in the corresponding area, it may be information important for determining priority of rescue.

Also, in the case in which an available emergency exit does not exist, the controller 150 may display information regarding how to cope with (or handle) the emergency, instead of the plan view denoting the structure of the building. For example, referring to FIG. 7C, in a case in which emergency occurs as a fire breaks out, the controller 150 may output corresponding information regarding how to cope with the fire to the display unit 170. The information regarding how to cope with the fire may be image data or video data. Although not shown, the user may search relevant detailed information by using the external input device 200.

Figure 8:
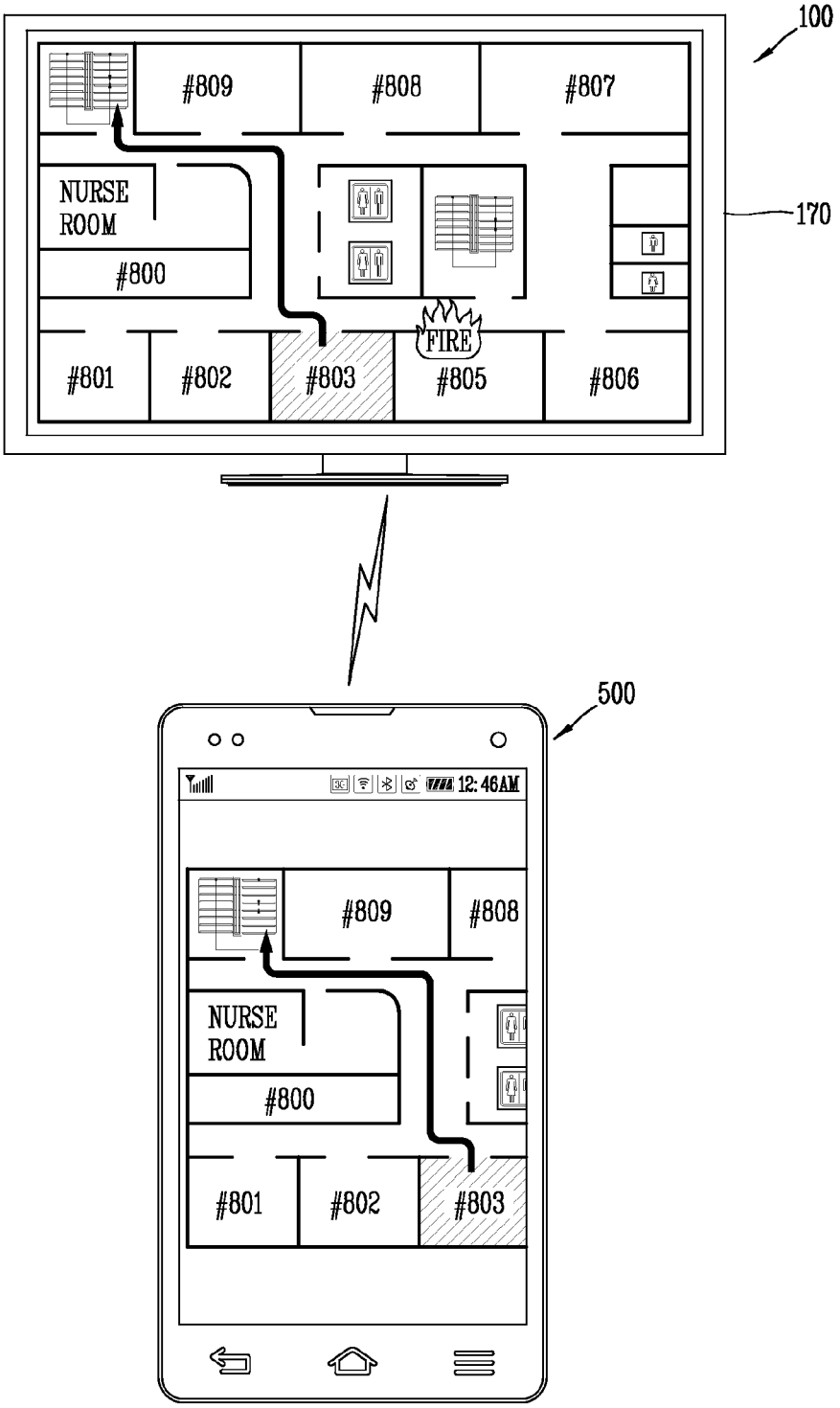
FIG. 8 is a conceptual view illustrating an interaction between the media device and a mobile terminal according to an exemplary embodiment of the present disclosure.

FIG. 8 is a conceptual view illustrating an interaction between the media device and a mobile terminal according to an exemplary embodiment of the present disclosure.

Referring to FIG. 8, the media device 100 may map a fire escape route leading to an emergency exit closest to the location in which the media device 100 is installed to the plan view denoting the structure of the building, and display the same. In this case, the controller 150 may capture an image of the plan view to which the fire escape route is mapped. Namely, the controller 150 may select a portion of the image output to the display unit 170 and store it as image data.

Also, the controller 150 may transmit the captured image data to an external terminal by using the signal input/output unit 130. For example, the media device 100 is a fixed terminal which cannot be carried around due to a restriction such as a size thereof. Thus, the user may need to memorize the information regarding the closest emergency exit and map information. Here, the user may receive image data transmitted from the media device 100 by using the mobile terminal 500. The user may display the fire escape route on the mobile terminal 500 by using the received image data, and effectively escape from the building according to the fire escape route.

As described above, according to an exemplary embodiment of the present disclosure, since a fire escape route leading to the emergency exit closest to the location in which the media device 100 is installed is displayed, the user may promptly and stably escape from the emergency by using the displayed information. Also, since the media device 100 captures the displayed information regarding the fire escape route and transmits the same to the external terminal, the user may receive the fire escape route information by the mobile terminal and use it as a map guiding an emergency exit. Also, when there is no available emergency exit, a rescue request signal is transmitted to the outside and information regarding how to cope with the emergency, instead of a fire escape route, is displayed, the people in need of rescue may be reassured and rescue workers may determine rescue order by using the rescue request signal.

According to exemplary embodiments of the present disclosure, in the occurrence of emergency such as a fire, or the like, a fire escape route leading to an emergency exit closest to a location in which each media device is installed in a building is output, inducing optimal escape. Also, since information regarding how to cope with the emergency according to an area in which a media device is installed is displayed, information fitting a particular situation can be delivered. Thus, it may help people a lot in emergency such as a fire, or the like.

The foregoing exemplary embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described exemplary embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A media device comprising:

a display unit configured to output a plan view denoting a structure of a building;

a signal input/output unit configured to, when emergency occurs, receive information regarding a location in which emergency has occurred from a management center; and a controller classifying a plurality of emergency exits disposed in the building into available emergency exits and unavailable emergency exits by using the location information, mapping a fire escape route leading to an emergency exit closest to the location in which the media device is installed, among the available emergency exits, and outputting the fire escape route leading to an emergency exit closest to the location to the display unit, wherein the controller captures an image of the plan view to which the fire escape route is mapped, and transmits the captured image data to an external terminal, and wherein when there is no available emergency exit classified among the plurality of emergency exits, the controller transmits a rescue request signal to the management center by using the signal input/output unit.

2. The media device of claim 1, wherein the location information includes a wake-up signal for waking up a power-off state, and the controller supplies power to the display unit to output at least one of the plan view and the fire escape route in response to the wake-up signal.

3. The media device of claim 1, wherein the controller further outputs information regarding how to cope with the emergency.

4. The media device of claim 1, wherein, in outputting the plan view, the controller outputs the available emergency exits and the unavailable emergency exits discriminately.

5. A method of controlling a media device including a controller, the method comprising:

when emergency occurs in a building, receiving location information by the media device regarding a location in which the emergency has occurred from a management center;

classifying by the controller a plurality of emergency exits disposed in the building into available emergency exits and unavailable emergency exits by using the received location information;

calculating by the controller a fire escape route leading to an emergency exit closest to the location in which the media device is installed among the available emergency exits; and outputting by the controller a plan view denoting a structure of the building to a display unit, and mapping the calculated fire escape route to the plan view and outputting the calculated fire escape route to the display unit, capturing an image of the plan view to which the fire escape route is mapped, and transmitting the captured image data to an external terminal, and transmitting a rescue request signal to the management center when there is no available emergency exit classified among the plurality of emergency exits.

6. The method of claim 5, wherein the location information includes a wake-up signal for waking up a power-off state, and the method further comprising:

supplying power to the display unit to output at least one of the plan view and the fire escape route in response to the wake-up signal.

* * * * *